US006913480B2

(12) United States Patent
Wilcox

(10) Patent No.: US 6,913,480 B2
(45) **Date of Patent: *Jul. 5, 2005**

(54) CONNECTOR FOR MAKING CONNECTION WITH MATING INTERFACE

(75) Inventor: David Mark Wilcox, Chelmsford (GB)

(73) Assignee: EEV Limited, Essex (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 85 days.

(21) Appl. No.: 09/403,288

(22) PCT Filed: Jan. 16, 1998

(86) PCT No.: PCT/GB98/01111

§ 371 (c)(1),
(2), (4) Date: Feb. 8, 2000

(87) PCT Pub. No.: WO98/48486

PCT Pub. Date: Oct. 29, 1998

(65) Prior Publication Data

US 2002/0025714 A1 Feb. 28, 2002

(30) Foreign Application Priority Data

Apr. 19, 1997 (GB) ..... 9707944

(51) Int. Cl.[7] ..... H01R 13/64
(52) U.S. Cl. ..... 439/372; 439/953
(58) Field of Search ..... 439/346, 345, 439/372, 953, 41, 42

(56) References Cited

U.S. PATENT DOCUMENTS 4,231,003 A 10/1980 Ishimaru ..... 333/33
5,836,781 A * 11/1998 Hyzin ..... 439/348

FOREIGN PATENT DOCUMENTS

GB 2155096 9/1985

* cited by examiner

*Primary Examiner*—Brian Sircus
*Assistant Examiner*—J. F. Duverne
(74) *Attorney, Agent, or Firm*—Donald C. Casey, Esq.

(57) ABSTRACT

A connector for making an electrical connection with a mating interface (17) includes a hollow conductor (1) within which is included a member (9) which is relatively movable with respect to the conductor (1). Resilient means (12), which may be a spring, is located between the conductor (1) and member (9). In a first state of the connector, the conductor (1) and member (9) are in a relative position in which the resilient means (12) exerts a force between them urging them together. Following a mechanical connection made between the member (9) and the mating interface (17), the connector is set in a second state in which the force applied by the resilient means (12) takes effect, moving the conductor (1) and member (9) towards one another to make an electrical connection between the conductor (1) and the mating interface (17). This allows a connection to be made with only minimal force and no torque, making it suitable for fragile connections. It is particularly useful for connections which must be made under vacuum.

17 Claims, 3 Drawing Sheets

CONNECTOR FOR MAKING CONNECTION WITH MATING INTERFACE

This invention relates to a connector and more particularly, but not exclusively, to a coaxial connector in which electrical connection to the inner conductor may be made under vacuum.

There are many types of connector available which are suitable for making connections between a coaxial line and mating component, which may be another coaxial line, using various clamps, screw fittings and the like. However, difficulties may arise with conventional types of connector where the connection is to be made to a particularly fragile mating component which is unable for example, to tolerate large insertion forces or torque. Problems may also occur for example where the connector must be installed in an apparatus and electrical connection made at some time subsequent to installation after the apparatus has been evacuated.

The present invention arose from considering the particular difficulties involved in making electrical connections under vacuum using minimal insertion force and torque but it is envisaged that it may also be of use for other less demanding applications.

According to a first aspect of the invention there is provided a connector for making electrical connection with a mating interface comprising: a hollow cylindrical conductor having a longitudinal axis; a member located within the conductor and capable of making a mechanical connection with the mating interface, the conductor and member being relatively movable in the direction of the longitudinal axis; and resilient means located between the conductor and member; and the connector having a first state in which the conductor and member are maintained in a position relative to one another such that the resilient means applies a force between them to urge them together, and the connector having a second state in which, after a mechanical connection has been made between the member and the mating interface, the force applied by the resilient means takes effect to move the conductor and member towards one another whereby an electrical connection is made between the conductor and a component of the mating interface.

By employing the invention, the conductor is drawn into electrical connection with a conductive part of the interface to which it is to be connected by action of the resilient means. The amount of force exerted by the resilient means may be chosen so as to exert only a minimal force necessary to make and maintain an electrical connection. Hence even where an interface is vulnerable to damage by only a moderate insertion force an electrical connection may be made safely using the invention. Furthermore, no torque is necessary to make the electrical connection.

The conductor may be an inner conductor of a coaxial line.

The member is preferably an elongate shaft but may be of any other configuration which permits it to move when required relative to the inner conductor and to be acted on by the resilient means. The cylindrical conductor may have any cross-sectional shape but typically has an annular cross-section.

In one method of using the invention, the connector is placed in the first state by moving the member and conductor relative to one another and maintaining them in position by a latch mechanism or jig, the resilient means exerting a force on them. The connector is then located in position in a system in which it is to be installed and the member mechanically connected to the mating interface by partially or fully engaging them. Following installation of the connector, a vacuum may then be established within the system. At some subsequent time, when it is decided to make the electrical connection between the conductor and the associated part of the system, the resilient means is released from its compressed or tensioned state such that it causes the member and conductor to move relative to one another. If the member is only partially engaged with the mating interface, this action also causes full engagement between the two. As the member is engaged with the mating interface, the action of the resilient means in moving the conductor and the member relative to one another also causes the electrical connection to be made between the conductor and the mating member. To make the electrical connection between the conductor and the mating member it is necessary that one or both of them is movable. The invention is particularly advantageously applied therefore, where the part to which the connector joins includes a flexible mating part, particularly where the electrical connection is to be made when the system is already under vacuum.

Another advantage of the invention is that it permits repeated electrical connection and disconnection by moving the conductor between its first and second states. This can be carried out with the system maintained under vacuum.

In one particularly advantageous embodiment of the invention, the resilient means comprises spring means but other types of biasing may be used. The resilient means may comprise for example, a helical spring which surrounds the member, the spring bearing at one of its ends against the member or to a flange attached thereto, and at its other end to the inner wall of the conductor. The bearing surface of the conductor may be a circular ledge, a plurality of supports or some other fixing means to locate it in position. Means may be provided for adjusting the magnitude of the force exerted by the resilient means on the interface to which the connector is to be electrically coupled. For example, the member may be in two threaded sections and its axial length adjustable by rotating one section with respect to th e other, or a telescopic fitting may be used. In another arrangement, a flange attached to the member and against which the resilient means bears may be adjustable in position along the length of the member and lockable in position once the desired tension has been set. Where the connector is to be used with an apparatus under vacuum, the force exerted by the resilient means must be set so as to take into account the effect of atmospheric pressure when the making the electrical connection. Although it is preferred that the resilient means comprises a spring, other forms of biassing may be employed in a connector in accordance with the invention. For example, a plurality of elastomer straps may be used or a cylinder or block of a resiliently deformable substance.

Preferably, a diaphragm is included located between the member and the inner wall of the conductor, being joined to the member and the conductor by gas tight seals. The diaphragm may then form part of a vacuum envelope when the system is placed under vacuum. The diaphragm may be a simple planar disc but preferably is a bellows arrangement as this allows a greater amount of movement of the member with respect to the conductor.

Preferably, the end of the conductor at which electrical connection is made to the interface portion is configured as a knife edge in which the outer part of the end of the conductor makes the connection. This encourages electrical current to travel around the outside of the conductor, avoiding losses through the member used to make and lock the inner conductor to the interface part.

The invention may also provide an additional benefit by providing a path for conducting excess heat from the region of the joint via the member located within the conductor.

The member may be mechanically connected to the mating interface using one of several different mechanisms. For example, the mating interface may include an aperture of a configuration which allows the member to move freely through the aperture when the member and aperture are in one alignment, but when the member is rotated relative to the aperture, the member cannot move through the aperture. The member for example, may include a transverse rod at its end and the mating plate has an elongate slot of the corresponding width and length therein. The aperture in such a case is most conveniently extensive through the entire thickness of the plate. However, in some arrangements it may be desirable to have a blind hole therein to receive the end of the member. In another arrangement, the mating interface may include a latch mechanism which engages with a corresponding part on the end of the member, or vice versa, to make the mechanical connection between them. The mating interface may be a solid planar disc, for example, but in other embodiments it may comprise a mesh or even a single rod adapted to make the connection with the member located within the conductor.

According to a second aspect of the invention, a method making an electrical connection with a mating interface includes the steps of: providing a connector comprising a hollow cylindrical conductor having a longitudinal axis, a member located within the conductor and capable of making a mechanical connection with a mating interface, the conductor and member being relatively movable in the direction of the longitudinal axis, and resilient means being located between the conductor and member;

moving the member relative to the conductor to place the connector in a first state in which the resilient means applies a force between the conductor and member whilst maintaining the conductor and member in their relative position;

engaging the member with the mating interface to make a mechanical connection between them; and then placing the connector in a second state which allows relative movement to occur between the conductor and member such that the resilient means urges them together in an axial direction, whereby an electrical connection is made between the conductor and a component of the mating interface.

Subsequently, or prior to the electrical connection being made, a vacuum may then be established such that the mating interface is located within the vacuum envelope.

Some ways in which the invention may be performed are now described by way of example with reference to the accompanying drawings in which:

FIG. 1 schematically illustrates in section a connector in accordance with the invention;

Figure 1:
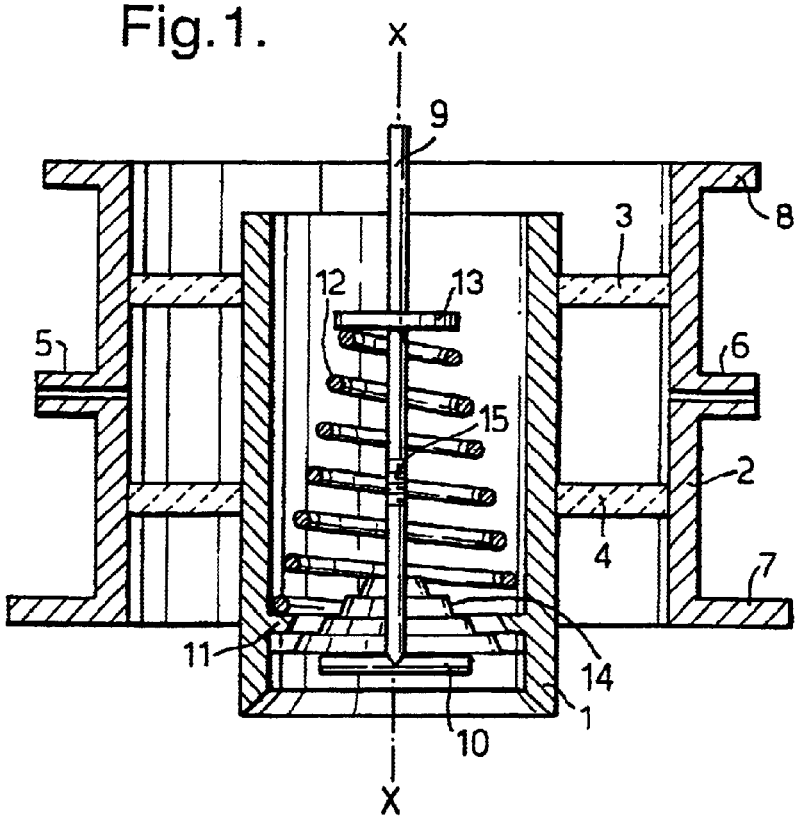

With reference to FIG. 1, a coaxial connector in accordance with the invention which is to be joined to a mating interface in an apparatus includes an inner conductor 1 and an outer conductor 2 having a longitudinal axis X—X, with two ceramic windows 3 and 4 located transversely between them and spaced apart from one another. In this particular embodiment of the invention, in use, it is intended that one of the ceramic windows 4 forms part of a vacuum envelope when the connector is installed in the apparatus. The second ceramic window 3 provides a backup should the first window 4 fail. Ports 5 and 6 permit cooling fluid such as water or air to be introduced into the region between the two ceramic windows 3 and 4 providing the first window 4 maintains its vacuum integrity.

The outer conductor 2 includes a circular flange 7 at one end at which connection is made to the apparatus and a second flange 8 at its other end to enable another component to be connected to the coaxial connector if required.

An elongate shaft 9 is located inside the inner conductor 1 and is aligned with its longitudinal axis X—X. The shaft 9 includes a transverse rod 10 at one end and is movable with respect to the inner conductor 1 in an axial direction. The inner wall of the inner conductor includes a projection 11 which supports one end of a helical spring 12, the other end of which bears on a flange 13 fixed to the shaft 9. A stainless steel bellows diaphragm 14 is located within the inner conductor, being sealed to the shaft 9 at its inner periphery and to the inner wall of the inner conductor 1 around its outer circumference. The connector as shown in FIG. 1 is in a first position in which the spring 12 exerts no force between the shaft 9 and inner conductor 1. The shaft 9 is in two sections and includes a screw thread 15 to enable its axial length to be adjusted and hence allow the tension of the spring 12 to be adjusted.

Figure 2:
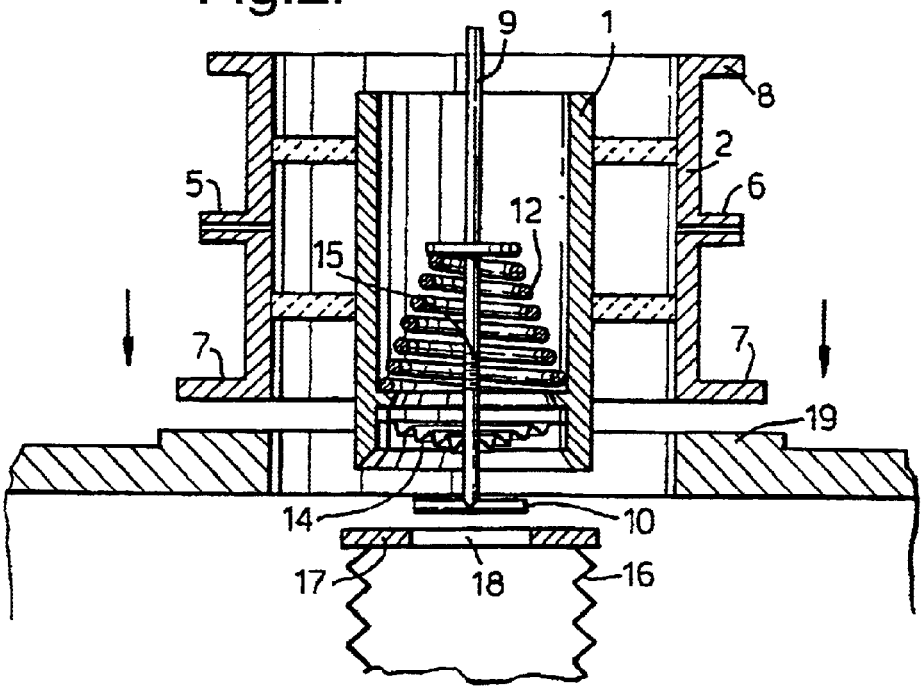
FIG. 2 shows the connector of FIG. 1 in a first state prior to connection to an apparatus.

With reference to FIG. 2, prior to installing the connector in the apparatus, the shaft 9 is moved relative to the inner conductor 1 by a jig (not shown) in an axial direction such that the rod 10 projects beyond the end of the inner conductor 1. The flange 13 attached to the shaft 9 thus moves closer in an axial direction to the projection 11, compressing the spring 12. The bellows 14 permits movement of the shaft 9 whilst remaining sealed to it and to the inner conductor 1. The jig is a framework which is clamped to the connector at the shaft 9 and the inner conductor 1. The jig includes moveable parts controlled by a geared mechanism to provide the required relative movement between the shaft 9 and the inner conductor 1.

The jig maintains the relative positions of the inner conductor 1 and shaft 9. In another embodiment, (not shown) a locking mechanism is included as part of the connector itself to maintain the connector in this first state.

The part of the apparatus to which the connector is to be attached includes a cylindrical flexible interface 16 which, when the electrical connection is made, forms part of the electrically conductive path. A metal disc forms a mating interface 17 and is located over the end of the interface 16. It includes an aperture 18 therethrough which has a width and length which permits rod 10 of the connector to pass through it. The connector, maintained in its first state with the spring 12 under compression, is moved in the direction shown by the arrow towards the flexible interface 16. The flange 7 on the outer conductor 2 of the connector is brought into contact with a corresponding mount 19 on the apparatus to which connection is to be made. The relative dimensions of the components are such that when the flange 7 and mount 19 are in contact, the shaft 9 extends through the aperture 18 and the rod 10 is located behind the interface 17.

Figure 3:
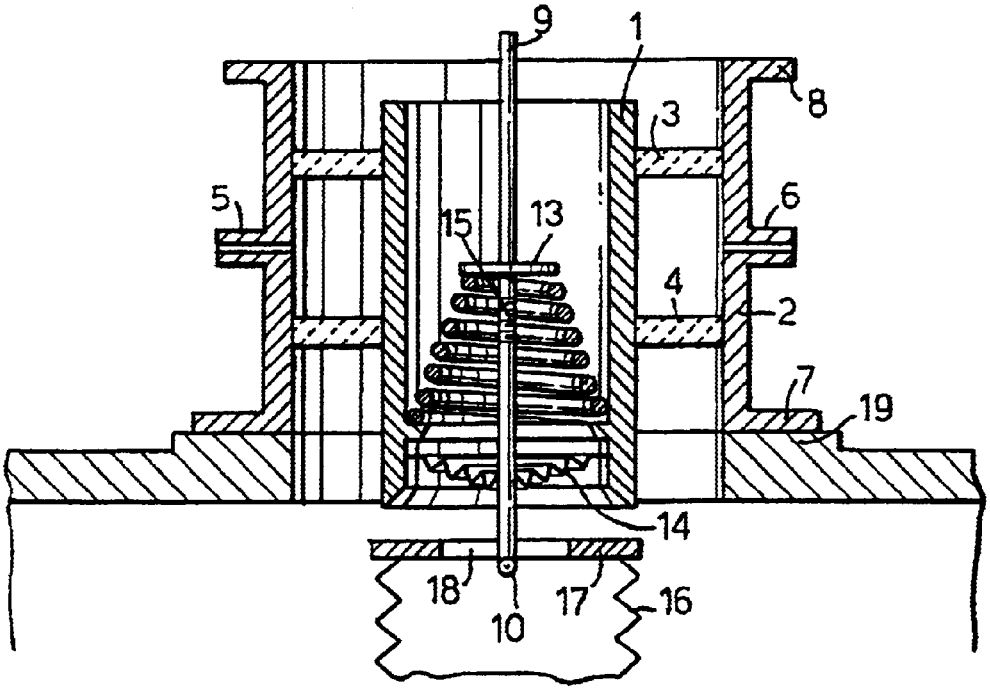
FIG. 3 shows the connector of FIG. 1 prior to an electrical connection being made.

The connector is then rotated through 90° such that the alignment between the rod 10 and slot 18 is changed. The shaft 9 is thus mechanically connected to the mating interface 17. Following rotation of the connector relative to the interface 16, the components are located as shown in FIG. 3. The flange 7 is secured to the mount 19 and the part of the apparatus, which includes the flexible member 16, is evacuated. The vacuum envelope is partly constituted by the ceramic window 4 and the bellows diaphragm 14. At this time although the connector is in place and the system has been evacuated, no electrical connection has been made between the coaxial connector and the flexible interface 16.

Figure 4:
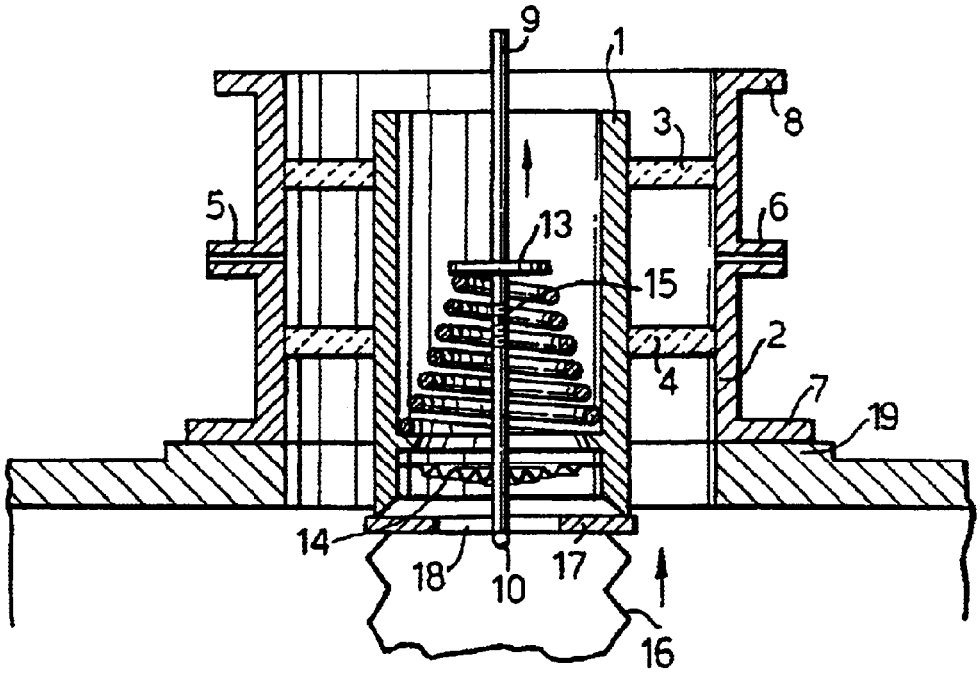
FIG. 4 shows the connector of FIG. 1 following the electrical connection being made.

To make the electrical connection, the jig maintaining the spring 12 in compression is released, setting the connector in a second state and allowing the spring 12 to cause relative movement between the shaft 9 and the inner conductor 1. In this embodiment, the inner conductor 1 is fixed in position by the flange 7 bolted to the mount 19. The movement tending to restore equilibrium of the system is therefore wholly undergone by the shaft 9 moving in the direction shown by the arrow in FIG. 4. As the connector was rotated following insertion of the rod 10 through the slot 18, the rod 10 cannot pass through it. Thus the mating interface 17 is drawn towards the inner conductor 1, the flexible member 16 accommodating this movement. The knife edge at the end of the inner conductor 1 makes contact with the plate 17 around its outer circumference, forming an electrically conductive path therethrough to the flexible member 16. Electrical current will tend to flow around the outside of the inner conductor 1 and flexible conductor 16.

Other configurations of rod and aperture may be used. For example, the rod may be triangular, and rotation through 30° will make the mechanical connection. Many other configurations are of course possible.

Following installation of the connector in the system, the electrical connection may be broken if necessary by moving the shaft 9 downwardly as shown relative to the inner conductor 1 and this may be carried out whilst maintaining the vacuum. Repeated electrical connection and disconnection may be made if required.

In an alternative embodiment, the conductor 1 may be allowed to move. For example, a deformable washer may be included between the flange 7 and mount 19. In that case, the interface component of the apparatus may be rigid and immovable or it may also be movable to some extent to allow the electrical connection to be made when the connector is set in its second state.

Figure 5A:
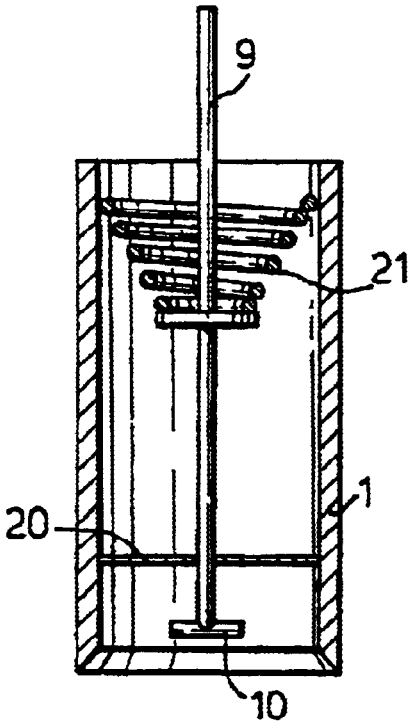
FIGS. 5*a* and 5*b* schematically show another connector in accordance with the invention in different states.
Figure 5B:
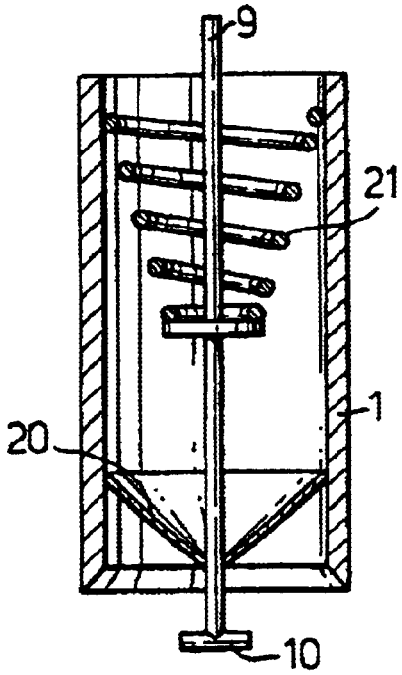

Another embodiment of the invention is schematically illustrated in FIGS. 5*a* and 5*b* in which like parts have like references to the connector in FIG. 1. In this arrangement, the bellows diaphragm 14 is replaced by a simple planar diaphragm 20. A spring 21 is attached to the shaft 9 and to the inner wall of a conductor 1 at its ends. As shown in FIG. 5*b*, when the shaft 9 is moved to its first state, the spring 21 is in tension. The connector is then fixed to an apparatus including a mating interface and the mechanical and electrical connections made in a similar manner to that described above with reference to the connector of FIG. 1.

What is claimed is:

1. A connector for making electrical connection with a mating interface comprising: a hollow cylindrical conductor having a longitudinal axis; a member located within the conductor and capable of making a mechanical connection with the mating interface, the conductor and member being relatively movable in the direction of the longitudinal axis; and resilient means located between the conductor and member; and the connector having a first state in which the conductor and member are maintained in a position relative to one another such that the resilient means applies a force between them to urge them together, and the connector having a second state in which, after a mechanical connection has been made between the member and the mating interface, the force applied by the resilient means takes effect to relatively move the conductor and member towards one another whereby an electrical connection is made between the conductor and a component of the mating interface.

2. A connector as claimed in claim 1 wherein the conductor is an inner conductor of a coaxial line.

3. A connector as claimed in claim 1 wherein the second state of the connector, the conductor is fixed in position and the member moves towards it.

4. A connector as claimed in claim 1 wherein the resilient means comprises spring means.

5. A connector as claimed in claim 1 and including means for adjusting the force applied by the resilient means when the connector is in the first state.

6. A connector as claimed in claim 1 wherein the member is an elongate shaft extensive in a direction parallel to the longitudinal axis.

7. A connector as claimed in claim 1 wherein the member is configured so as to pass through an aperture in the mating interface when the aperture and member are aligned and when the member moves out of alignment with the aperture it is unable to pass through the aperture.

8. A connector as claimed in claim 1 wherein the conductor has a knife edge at which the electrical connection is made between it and the component of the mating interface.

9. A connector as claimed in claim 1 and including a diaphragm located between the inner wall of the conductor and the member and having gas tight seals at its boundaries.

10. A connector as claimed in claim 9 wherein the diaphragm is a bellows diaphragm.

11. A connector as claimed in claim 1 and including a releasable lock for maintaining the connector in said first state.

12. A connector arrangement comprising a connector as claimed in claim 1 and an apparatus having a mating interface to which said mating surface is connected.

13. A connector arrangement as claimed in claim 12 and wherein the mating interface is located in a region under vacuum.

14. A method of making an electrical connection between a conductor and a mating interface including the steps of: providing a connector comprising a hollow cylindrical conductor having a longitudinal axis, a member located within the conductor and capable of making a mechanical connection with a mating interface, the conductor and member being relatively movable in the direction of the longitudinal axis, and resilient means being located between the conductor and member;

moving the member relative to the conductor to place the connector in a first state in which the resilient means applies a force between the conductor and member whilst maintaining the conductor and member in their relative position;

engaging the member with the mating interface to make a mechanical connection between them; and then placing the connector in a second state which allows relative movement to occur between the conductor and member such that the resilient means urges them together in an axial direction, whereby an electrical connection is made between the conductor and a component of the mating interface.

15. A method as claimed in claim 14 wherein the electrical connection is made while the mating interface is located in a region under vacuum.

16. A method as claimed in claim 15 wherein the connector is set in its first state, the connector is then installed in an apparatus which includes the mating interface and the mechanical connection made, the apparatus is then evacuated to place it under vacuum, and the electrical connection is then made.

17. A method as claimed in claim 15 wherein following the electrical connection being made said connection is then broken by moving the member relative to the conductor and the vacuum is maintained during disconnection.

* * * * *

UNITED STATES PATENT AND TRADEMARK OFFICE

CERTIFICATE OF CORRECTION

PATENT NO. : 6,913,480 B2
DATED : July 5, 2005
INVENTOR(S) : David Mark Wilcox

It is certified that error appears in the above-identified patent and that said Letters Patent is hereby corrected as shown below:

Title page,
Item [22], should read:
-- [22] PCT Filed: April 16, 1998 --.

Signed and Sealed this

Eleventh Day of April, 2006

JON W. DUDAS
*Director of the United States Patent and Trademark Office*